United States Patent [19]

Buoli

[11] Patent Number: 4,748,427

[45] Date of Patent: May 31, 1988

[54] MICROWAVE RESONATING CAVITY WITH METALLIZED DIELECTRIC

[75] Inventor: Carlo Buoli, Mirandola, Italy

[73] Assignee: GTE Telecommunicazioni, S.p.A., Milan, Italy

[21] Appl. No.: 927,461

[22] Filed: Nov. 6, 1986

[30] Foreign Application Priority Data

Nov. 20, 1985 [IT] Italy ..... 23904/85[U]

[51] Int. Cl.[4] ..... H01P 7/06

[52] U.S. Cl. ..... 333/227; 333/230; 333/231

[58] Field of Search ..... 333/219, 227, 230, 231, 333/232

[56] References Cited

U.S. PATENT DOCUMENTS

| | | | |
|---|---|---|---|
| 3,358,180 | 12/1967 | Jolly | 333/227 X |
| 3,757,204 | 9/1973 | Hyde | 333/227 X |
| 4,035,749 | 7/1977 | Slocum et al. | 333/232 |
| 4,121,941 | 10/1978 | Kawashima et al. | 333/219 X |
| 4,255,729 | 3/1981 | Fukasawa et al. | 333/219 X |
| 4,271,399 | 6/1981 | Morita | 333/219 |
| 4,318,064 | 3/1982 | Käch | 333/219 X |
| 4,337,446 | 6/1982 | O'Bryan, Jr. et al. | 333/238 |
| 4,454,489 | 6/1984 | Donazzan et al. | 333/227 |
| 4,506,241 | 3/1985 | Makimeto et al. | 333/219 X |
| 4,560,965 | 12/1985 | Gosling et al. | 333/219 |
| 4,580,116 | 4/1986 | Ballato | 333/219 X |
| 4,639,699 | 1/1987 | Nishikawa et al. | 333/219 X |
| 4,668,925 | 5/1987 | Towatari et al. | 333/219 |

*Primary Examiner*—Eugene R. LaRoche
*Assistant Examiner*—Seung Ham
*Attorney, Agent, or Firm*—Jeffrey P. Morris

[57] ABSTRACT

A microwave resonating cavity including a hollow cylindrical body shaped in the form of a parallelepiped and consisting of a dielectric material coated by a metallic layer, said dielectric material having a high dielectric constant having a value greater than 30, and wherein said hollow body includes an upper base, a lower base, an external surface and an internal surface, and further includes a non-metallized area defining a metallized coupling line onto the external surface of the said hollow cylinder and wherein said hollow cylinder has an inner diameter ranging between 3 and 5 mm, an outer diameter ranging between 6 and 15 mm and a height ranging between 5 and 10 mm, and further including a metallic cap welded to the upper base of said hollow body, and further including an adjusting screw for fine adjustment of the resonating frequency.

4 Claims, 1 Drawing Sheet

X-X'

Y-Y'

X-X'

MICROWAVE RESONATING CAVITY WITH METALLIZED DIELECTRIC

Figures 1, 2, 3, 4, 5:
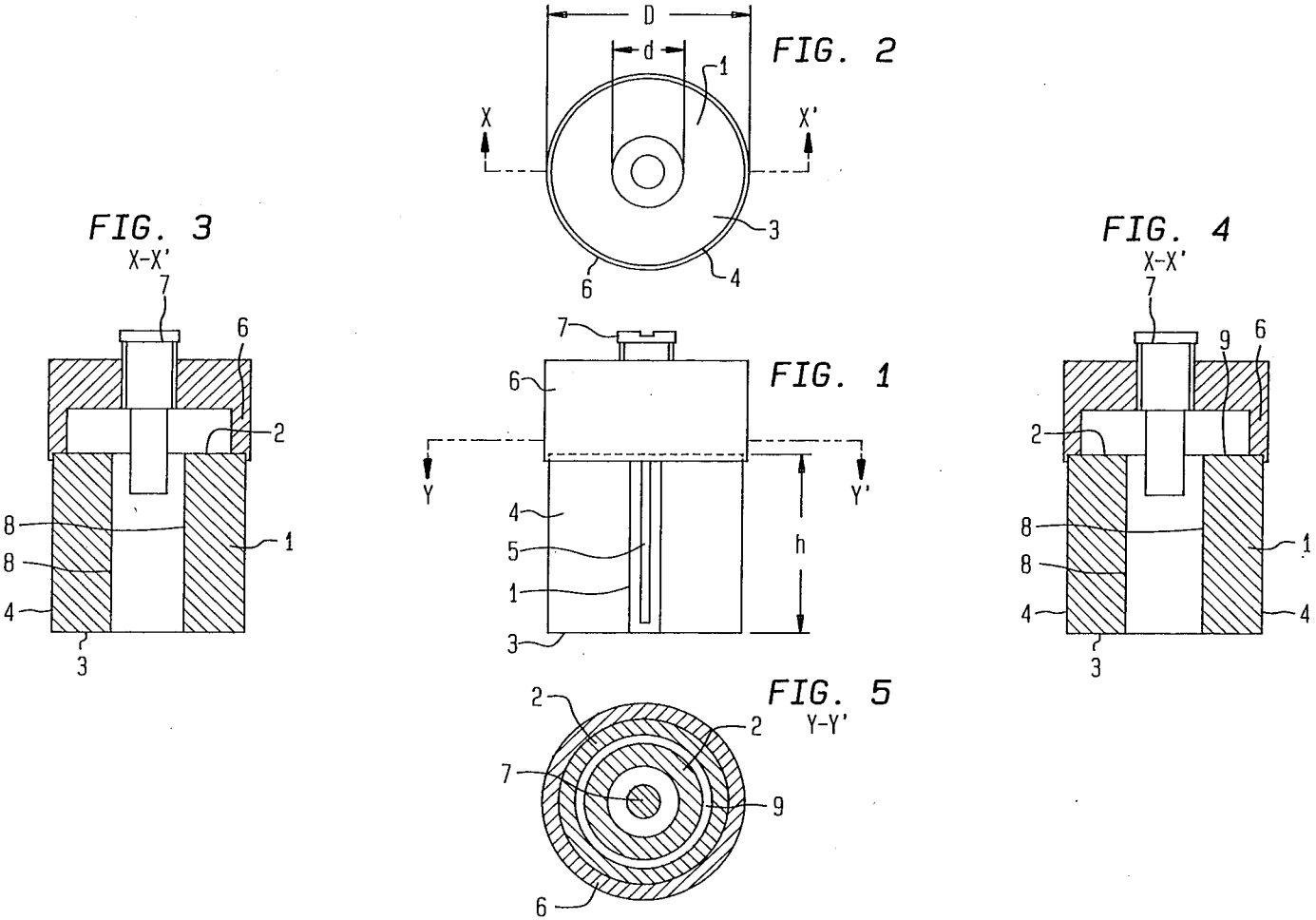

The present innovation refers to a microwave resonating cavity including an hollow body made by a dielectric material coated by a metallic layer.

It is known that in microwave oscillators metallic resonating cavities are presently used and the said cavities are very cumbersome and require a complex and expensive mechanical machining.

It is also known that the resonating frequency of the said metallic cavities is influenced by temperature, humidity and mechanical vibrations and that, in order to improve the stability of the said resonating frequency, it is permanently controlled by a low-frequency quartz crystal using an automatic frequency control device.

It is also known that some types of microwave oscillators not provided with the said automatic frequency control facilities use resonating cavities implemented with a metallized amorphous quartz crystal. However the said oscillators, because of the thermal drifts of the active components of the circuit and the losses of the metallic layer of the resonator, feature a frequency stability not high enough in many applications and they need temperature compensation devices. Furthermore, the low value of the quartz crystal dielectric constant ($\epsilon r=3.8$) results in other drawbacks, including power radiation in the surrounding areas, which result in the generation of disturbances in the rest of the circuit, and to resonating cavities rather cumbersome for frequencies variable in the 500 MHz to 6 GHz band.

Therefore, the scope of the present innovation is to obviate the said inconvenience and to indicate a microwave resonating cavity, for oscillators complete with automatic frequency control, in which the resonating frequency is little influenced by temperature, humidity and mechanical vibrations, does not radiate power, is reduced in dimensions, is very simple to implement, reliable, and features production cost very reduced. In order to achieve the said purpose, the object of the present innovation is a microwave resonating cavity including an hollow body made by a dielectric material coated by a metallic layer, characterized by the fact that the said dielectric material features a high dielectric constant $\epsilon r$.

Further purposes and advantages of the present innovation will result clear from the detailed description given hereunder and the attached drawings, which are given for explanatory and not limitative reasons only, in which:

FIG. 1 is a front view of a microwave resonating cavity object of the present innovation, FIG. 2 is a bottom view of the microwave cavity in FIG. 1, FIG. 3 is a longitudinal section according to a plane X—X' of the microwave cavity in FIG. 1, FIG. 4 is a longitudinal section of according to a plane X—X' a second implementation of the microwave cavity object of the present innovation, and FIG. 5 is a section according to a plane Y—Y' of the microwave cavity in FIG. 4.

FIGS. 1, 2 and 3 show a microwave resonating cavity made by a dielectric material featuring a high dielectric constant, for instance $\epsilon r=38$, having the shape of an hollow cylinder 1, having an outer diameter D, an inner diameter d and a height h. The hollow cylinder 1 is metallized by a triple layer of titanium, palladium and gold on its upper base 2, on its lower base 3 and on all the external surface 4, excepting a U-shaped small area, which delimitates a metallic coupling line 5, necessary for the connection of the microwave resonating cavity with the rest of the circuit. To the upper base 2 of the hollow cylinder 1 a metallic cap 6 (for instance made by brass, aluminium or inivar) is welded.

The metallic cap 6 has a threaded central hole, not visible in the figures, in which a metallic adjusting screw 7 is inserted to provide for the fine adjustment of the resonating frequency of the cavity.

The configuration just illustrated implements a circular waveguide microwave resonating cavity in which the resonating frequency depends on the dielectric constant $\epsilon r$ of the material used, the inner diameter d, the outer diameter D and the height h of the hollow cylinder 1 and the position of the adjusting screw 7.

The best utilization of the circular waveguide microwave resonating cavity which minimizes insertion losses and permits to achieve very reduced dimensions, is in the frequency range from 3 to 6 GHz. In order to implement a resonating cavity in the said frequency range, the hollow cylinder 1 has been so dimensioned as to have an inner diameter d ranging between 3 and 5 mm, an outer diameter D ranging between 6 and 15 mm and a height h ranging between 5 and 10 mm. FIG. 4, in which the same elements as in the previous figures are indicated with the same reference number, differs from FIG. 3 in that the internal surface 8 of the hollow cylinder 1 has also been metallized and in that a circular corona 9 has been left without metallization in the upper base 2 of the hollow cylinder 1. The said circular corona 9 is better visible in FIG. 5, which represents a section according to a plane Y—Y' of the resonating cavity in FIG. 1. The configuration illustrated in FIGS. 4 and 5 implements a coaxial cable resonating cavity in which the resonating frequency depends on the dielectric constant $\epsilon r$ of the material used, the inner diameter d, the outer diameter D and the height h of the hollow cylinder 1 and the position of the adjusting screw 7.

The best utilisation of the coaxial cable resonating cavity which minimizes insertion loss and permits to achieve very reduced dimensions, is in the frequency range from 500 MHz to 2 GHz. In order to implement a coaxial cable resonating cavity in the said frequency range, the hollow cylinder 1 has been so dimensioned as to have an inner diameter d ranging between 3 and 6 mm, an outer diameter D ranging between 10 and 15 mm and a height h ranging between 5 and 20 mm.

The connection of the resonating cavity with the rest of the circuit is made via a metallic microstrip 5, however this connection could also be implemented by means of irises, i.e. via a number of slots properly positioned and dimensioned onto the hollow cylinder 1.

It is also possible, by properly shaping the dielectric material, to implement rectangular waveguide resonating cavities.

The advantages of the resonating cavity using metallized dielectric object of the present innovation result clear from the description made. In particular these advantages are in that the resonating frequency of the said cavity is little affected by temperature and humidity variations and mechanical vibrations, in that it does not radiate power and consequently does not cause any disturbance, in that it has very reduced dimensions, in that it is very simple to implement and in that it is reliable and a little expensive. It is clear that numerous modifications to the resonating cavity with metallized dielectric described as an example are possible by skilled in the art without loosing the principles of novelty inherent to the innovation.

I claim:

1. A microwave resonating cavity including a hollow cylindrical body shaped in the form of a parallelepiped and consisting of a dielectric material coated by a metallic layer, said dielectric material having a high dielectric constant having a value greater than 30, and wherein said hollow body includes an upper base, a lower base, an external surface and an internal surface, and further includes a non-metallized area defining a metallized coupling line onto the external surface of the said hollow cylinder and wherein said hollow cylinder has an inner diameter ranging between 3 and 5 mm, an outer diameter ranging between 6 and 15 mm and a height ranging between 5 and 10 mm, and further including a metallic cap welded to the upper base of said hollow body, and further including an adjusting screw for fine adjustment of the resonating frequency.

2. A microwave resonating cavity according to claim 1, wherein said hollow cylinder has the said upper base and the said lower base fully metallized and the said internal surface is non-metallized.

3. A microwave resonating cavity according to claim 1, wherein said hollow cylinder has the said upper base and the said lower base fully metallized and the said internal surface is non-metallized.

4. A microwave resonating cavity according to claim 3, wherein said hollow cylinder has an inner diameter ranging between 3 and 6 mm, an outer diameter ranging between 10 and 15 mm and a height ranging between 5 and 20 mm.

* * * * *